US006668903B1

(12) United States Patent
Good et al.

(10) Patent No.: US 6,668,903 B1
(45) Date of Patent: Dec. 30, 2003

(54) DETERMINING SEPARATION DISTANCE OF TWO SURFACES IN A HOSTILE ENVIRONMENT

(75) Inventors: Dave Good, Chelsea, MI (US); Tom Rozich, Au Gres, MI (US); William Seaton, Dexter, MI (US); Daniel D. Minor, Cadillac, MI (US); Kenneth D. Mc Kibben, Defiance, OH (US)

(73) Assignee: Hayes Lemmerz International, Inc., Northville, MI (US)

( * ) Notice: Subject to any disclaimer, the term of this patent is extended or adjusted under 35 U.S.C. 154(b) by 76 days.

(21) Appl. No.: 10/047,519

(22) Filed: Oct. 29, 2001

(51) Int. Cl.[7] ..... B22D 46/00
(52) U.S. Cl. ..... 164/4.1; 164/137; 264/40.5
(58) Field of Search ..... 164/4.1, 137, 150.1, 164/151, 154.8, 342; 264/40.5; 425/135; 73/37.5

(56) References Cited

U.S. PATENT DOCUMENTS 5,022,258 A * 6/1991 Wilson ..... 73/37.5
5,171,584 A * 12/1992 Ramsey et al. ..... 425/135
5,213,726 A * 5/1993 Ramsey et al. ..... 264/40.5

* cited by examiner

*Primary Examiner*—M. Alexandra Elve
*Assistant Examiner*—I.H. Lin
(74) *Attorney, Agent, or Firm*—MacMillan, Sobanski & Todd, LLC

(57) ABSTRACT

A sensor for measuring the distance between two surfaces injects pressurized fluid (e.g., air) between the surfaces. The pressurized fluid passes through two flow restrictors prior to reaching the surfaces to be measured. The fluid pressures between the flow restrictors and between the downstream flow restrictor and the surfaces are compared to yield the distance between the two surfaces. An accurate distance measurement can be obtained even where the surfaces to be measured are located in a hostile environment which would destroy many other types of sensors.

6 Claims, 7 Drawing Sheets

DETERMINING SEPARATION DISTANCE OF TWO SURFACES IN A HOSTILE ENVIRONMENT

BACKGROUND OF THE INVENTION

This invention relates in general to casting molds or other equipment and in particular to a method and apparatus for monitoring separation distance of two surfaces such as casting molds in a hostile environment such as high heat, smoke, dirt, oil mist, and sprays.

A casting mold is used to make various cast articles out of various materials. The casting mold typically includes two or more mold sections, such as for example a lower mold section and an upper mold section. When the lower mold section and the upper mold section are placed together in an abutting relationship, they cooperate to define a mold cavity. The mold cavity is generally in the shape of the cast articles to be produced. When the lower mold section and the upper mold section are placed together, a suitable molten or liquid fill material, such as for example, metal or plastic, is provided to fill the cavity and produce the cast article. Preferably, the fill material does not leak or seep out from the mold cavity as the fill material cools. Once sufficient cooling has occurred, the lower mold section and the upper mold section are separated from each other to enable the cast article to be removed.

The fill material used with the casting mold is typically obtained in a solid state, then heated to a liquid or molten state. The fill material may be heated in a furnace or other suitable apparatus. The fill material can leak (spill) from the mold cavity if the lower mold section and the upper mold section do not reach the desired separation or do not otherwise properly close together so as to define a sealed or closed mold cavity chamber. Depending on the particular molding process, it may be desirable for the two surfaces to come in contact (as with permanent metal molds) or to obtain a predetermined separation distance (as with sand molds).

Such leaks of the fill material are undesirable and can occur because one or both of the mold sections have become misshapen, misaligned, or do not totally close due to presence of dirt or flash, loss of hydraulic pressure, or inadequate lubrication. The resulting spill or leakage can be devastating to nearby components such as electrical wiring, hydraulic lines, coolant lines, limit switches, etc. Thus, it would be desirous to provide an improved method and apparatus for a casting mold that can be used so as to determine the relative positions of the mold sections before filling with molten metal.

SUMMARY OF THE INVENTION

This invention relates to a method and apparatus for monitoring a casting mold or other equipment to determine if the mold sections are properly closed in a sealing relationship. In a preferred embodiment, the distance between two surfaces is determined using the flow of pressurized air from a chamber through a first orifice into a pipe and then through a second orifice in one surface toward the other surface. The pressure drop between the chamber and the pipe is measured and quantifies the separation distance. For example, if the surfaces have a large separation distance then the second surface will not restrict the air flow and the pressure measured in the pipe will be approximately atmospheric pressure. As the surfaces approach one another, the pressure measured in the pipe will rise following a curve that can be determined empirically. When the surfaces come in contact, the pressure in the pipe will have risen to the pressure in the pressurized chamber. Thus, a reliable and accurate distance can be measured in extremely high temperature, smoky, or dusty environments. Other advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
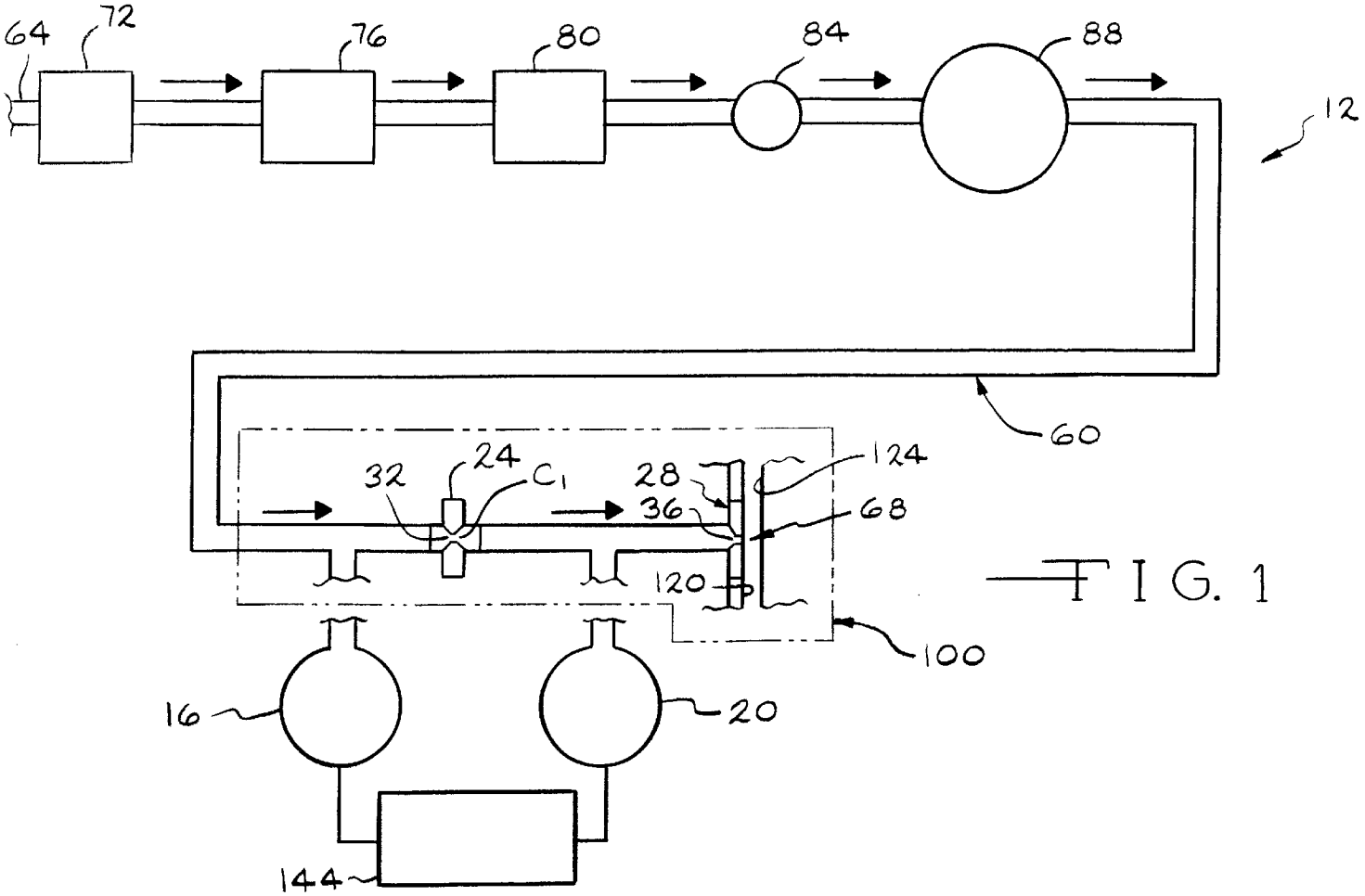
FIG. 1 is a schematic of a mold monitoring apparatus according to the present invention.
Figure 2:
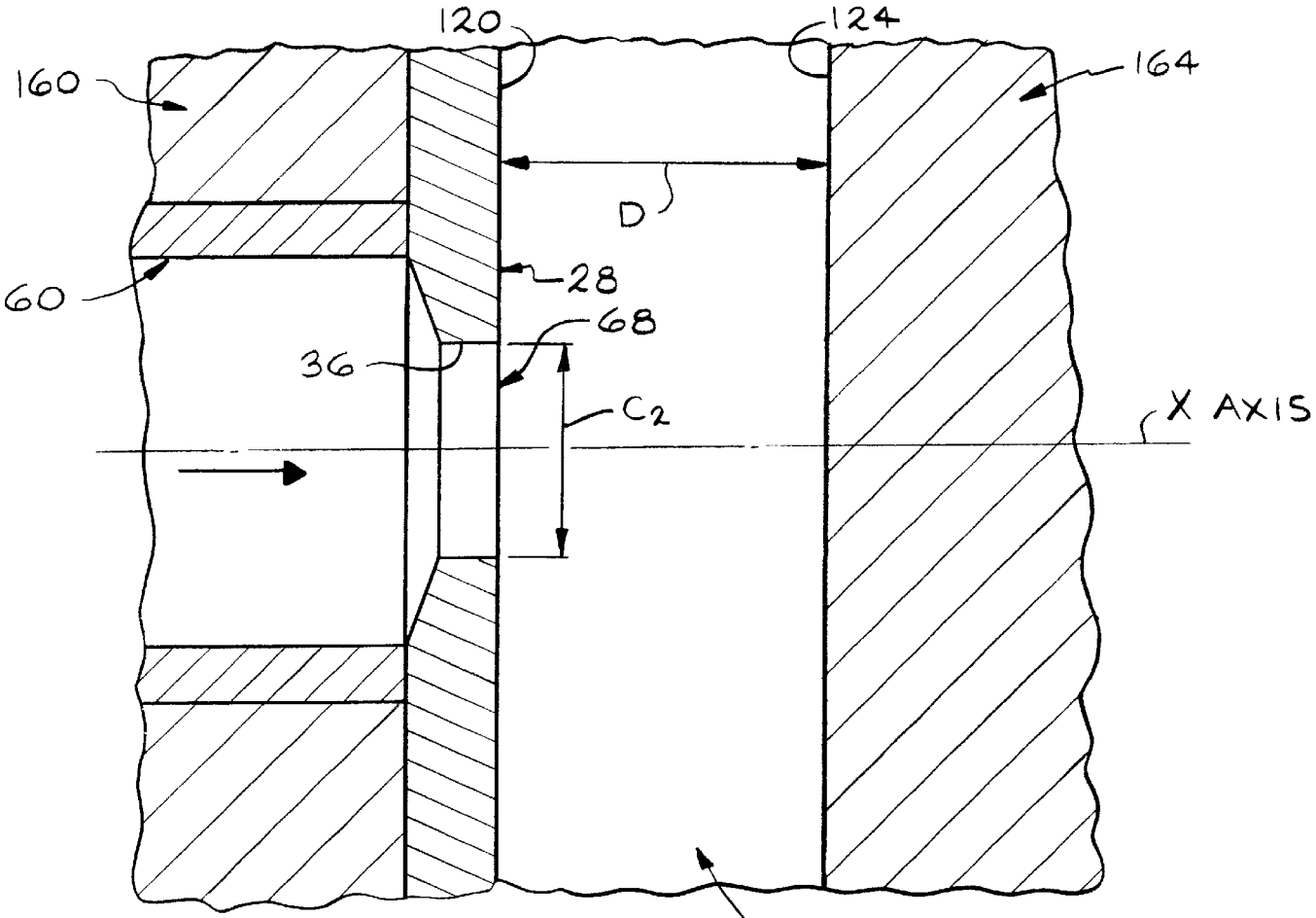
FIG. 2 is a schematic of a portion of the mold monitoring apparatus illustrated in FIG. 1.

Referring now to the drawings there is illustrated in FIGS. 1 and 2 a first embodiment of a mold monitoring apparatus, indicated generally at 12, in accordance with the present invention. Although this invention is discussed in conjunction with the particular mold monitoring mold apparatus disclosed herein, it will be appreciated that the invention may be used in conjunction with other kinds of mold constructions or with any applications where the separation distance of two closely-separated surfaces needs to be measured in a hostile environment that would degrade or destroy other types of measuring devices. Also, only those portions of the mold monitoring apparatus 12 that are necessary for a complete understanding of this invention will be described.

In the illustrated embodiment, the mold monitoring apparatus 12 includes a first transducer 16, a second transducer 20, a first restrictor 24 and a second restrictor 28. The first transducer 16 and the second transducer 20 are preferably both air pressure transducers, though other suitable transducers may be employed in the mold monitoring apparatus 12. As used herein, the term transducer is understood to include a device that is actuated by a stimulus and supplies power, usually in another form, to a second system. The term transducer is also understood to include a device that responds to a physical stimulus (for example, heat, light, sound, pressure, motion, flow, and the like), and produces a corresponding signal. The first transducer 16 and the second transducer 20 are positioned and operative to receive pressure from a fluid and to produce a first signal and a second signal, respectively. The fluid is preferably air, although it may include any suitable gas or liquid. The first signal and the second signal are preferably electrical signals, although they may include any suitable type of signal.

The illustrated first restrictor 24 and the second restrictor 28 are closures having inlet openings 32 and 36, respectively. The inlet openings 32 and 36 are preferably stepped openings. The illustrated inlet opening 32 is a round hole positioned approximately in the center of the first restrictor 24. The illustrated inlet opening 36 is a round hole positioned approximately in the center of the second restrictor 28. The inlet opening 32 defines a first restrictor major dimension C1. The major dimension C1 is understood to be the largest chord that can be drawn at the smallest part of the cross-section of the inlet opening 32. When the inlet opening 32 is a circle, the major dimension C1 is the diameter thereof. The inlet opening 36 defines a second restrictor major dimension C2. The major dimension C1 is understood to be the largest chord that can be drawn at the smallest part of the cross-section of the inlet opening 36. When the second opening 36 is a circle, the major dimension C2 is a diameter of the inlet opening 36. Preferably, the area of the inlet opening 32 is approximately equal to the area of the inlet opening 36. Also, the first restrictor 24 and the second restrictor 28 are preferably removable plates.

The illustrated mold monitoring apparatus 12 includes a fluid supply line 60. The illustrated fluid supply line 60 is a suitable conduit or pipe and includes a first or inlet opening 64 and a second or outlet opening 68. The illustrated mold monitoring apparatus 12 is positioned to allow the fluid to flow in the fluid supply line 60 from the inlet opening 64 to the outlet opening 68. The fluid supply line 60 is preferably positioned to allow for fluid communication between the first transducer 16, the first restrictor 24 and the second transducer 20, and the second restrictor 28.

The mold monitoring apparatus 12 further includes an air supply unit 72 to supply air to the inlet opening 64 thereof, although the mold monitoring apparatus 12 may employ other suitable sources of supply air. The illustrated mold monitoring apparatus includes an optional filter 76 and an optional dryer 80. In the illustrated embodiment, the second restrictor 28 is preferably positioned adjacent the outlet opening 68 of the fluid supply line 60. Alternatively, the second restrictor 28 may be positioned upstream of the outlet opening 68 or at any other suitable location along the path of the fluid supply line 60.

The illustrated mold monitoring apparatus 12 further includes an optional regulator 84 and an optional header 88. The regulator 84 is preferably an air regulator valve. The regulator 84 is positioned and operative to selectively control the pressure of the fluid in the fluid supply line 60. The illustrated header 88 defines a chamber in the fluid supply line 60. The header 88 is positioned and operative as a reservoir to selectively supply the fluid to the first restrictor 24.

The mold monitoring apparatus 12 of the present invention can be employed in a hostile environment indicated in FIG. 1 by dashed line 100. The term "hostile environment" as used herein is understood to include manufacturing and operator environments that are undesirable for machinery or human exposure. Nonlimiting examples of hostile environments include an environment that is generally characterized by extreme temperatures, for example, temperatures in excess of about 100° F. or temperatures less than about 400° F. degrees; pressures greater than about one atmosphere; the presence of harmful or objectionable gases or odors; the presence of objectionable levels of noise, light or radiation; or any other undesirable environment. The illustrated hostile environment 100 includes the first restrictor 24 and the second restrictor 28, though need not.

In the illustrated embodiment, the mold monitoring apparatus 12 includes a first mold end surface 120 of a first mold half 160 and a second mold end surface 124 of a second mold half 164. For purposes of clarity, the present invention will be discussed in terms of a two-piece mold system, although the present invention may be practice in other mold environments and is not limited to a two-piece mold system. In the illustrated embodiment, the first mold end surface 120 is preferably a generally flat surface and is positioned generally parallel to the second mold end surface 124, which is preferably a generally flat surface. The illustrated inlet opening 36 terminates at the first mold end surface 120. In operation, the first mold end surface 120 and the second mold end surface 124 are selectively movable relative to each other, though one of the first mold end surface 120 the second mold end surface 124 can be stationary. The first mold end surface 120 and the second mold end surface 124 move relative to each other in a manufacturing process or other operation. The inlet opening 36 terminates approximately at the first mold end surface 120. For the portion of the mold monitoring apparatus 12 shown in FIG. 2, the first mold end surface 120 and the second mold end surface 124 are spaced apart from each other by a fluid or gap 140. It will be appreciated that the first mold end surface 120 and the second mold end surface 124 are spaced apart by a distance "D" along mold axis "X". The illustrated axis "X" is oriented approximately perpendicular to the first mold end surface 120 and the second mold end surface 124.

The operation of the mold monitoring apparatus 12 of the present invention will now be discussed. A supply of the fluid, preferably air, is supplied at the inlet 64. The fluid is preferably under pressure. The fluid desirably flows through the filter 76, the dryer 80, the regulator 84, and the header 88 through the fluid supply line 60 to the first transducer 16. The first transducer 16 is exposed to the fluid. When the first transducer 16 receives the fluid, the first transducer 16 generates a first signal. The first signal preferably corresponds to the pressure of the fluid supplied to the first transducer 16. The fluid flows through the inlet opening 32 of the first restrictor 24 to the second transducer 20. When the second transducer 20 receives the fluid, the second transducer 20 generates a second signal. The second signal preferably corresponds to the pressure of the fluid supplied to the second transducer 20. The fluid then flows through the inlet opening 36 of the second restrictor 28.

The fluid next flows into the fluid gap 140 when the first mold end surface 120 and the second mold end surface 124 are spaced apart by the distance "D." When the first mold end surface 120 and the second mold end surface 124 are moved toward one another, the fluid flowing into the fluid gap 140 impinges on the second mold end surface 124. The fluid flow into the fluid gap 140 completely stops when the first mold end surface 120 and the second mold end surface 124 are positioned substantially in contact. The first mold end surface 120 and the second mold end surface 124 are positioned substantially in contact with each other, thus obstructing flow through the second opening 36, when the mold sections 160 and 164 are in their closed position (not shown). The relative movements of the first mold end surface 120 and the second mold end surface 124 produces a change in the second signal generated by the second transducer 20. It will be appreciated that the second mold end surface 124 is an impact surface for the fluid flow into the fluid gap 140. In operation, the first mold end surface 120 and the second mold end surface 124 move toward one another thus decreasing the distance "D." It will be appreciated that, as the distance "D" decreases the second signal increases. Likewise, as the distance "D" increases, the second signal decreases. Therefore, the distance "D" and thus the relative positions of the first mold end surface 120 and the second mold end surface 124 can be determined by comparing the first signal generated by the first transducer 16 and the second signal generated by the second transducer 20.

When the fill material (not shown) used in conjunction with the mold monitoring apparatus is molten aluminum, the first mold end surface 120 and the second mold end surface 124 are considered to be substantially in contact when separated by the distance "D" of less than about 0.007 inches apart from each other. It will be appreciated that molten aluminum "freezes" or does not flow between the first mold end surface 120 and the second mold end surface 124 when separated by the distance "D" of less than about 0.007 inches.

The illustrated mold monitoring apparatus 12 includes a controller 144, though a controller 144 is not necessary to practice the invention. The controller 144 is preferably operatively connected to the first transducer 16 and the second transducer 20 so as to receive the respective signals generated by each transducer. In the preferred embodiment, the controller 144 is operative to compare the first signal and the second signal to thereby determine the relative positions of the first mold end surface 120 and the second mold end surface 124. The controller 144 may also be employed to generate a signal representative of the distance "D."

The mold monitoring apparatus 12 of the present invention may be employed in a wide variety of environments. The mold monitoring apparatus 12 may be employed in the hostile environment 100 that is a molding environment, although use of the mold monitoring apparatus 12 is not limited to the molding environment. The illustrated first surface 120 is a surface of the first mold half 160, and the illustrated second surface 124 is a surface of the second mold half 164. It will be appreciated that, in operation, the first mold half 160 and the second mold half 164 move relative to each other, thus decreasing the distance "D". Therefore, the distance and thus the relative positions of the first mold half 160 and the second mold half 164 can be determined by comparing the first signal and the second signal.

Figure 3:
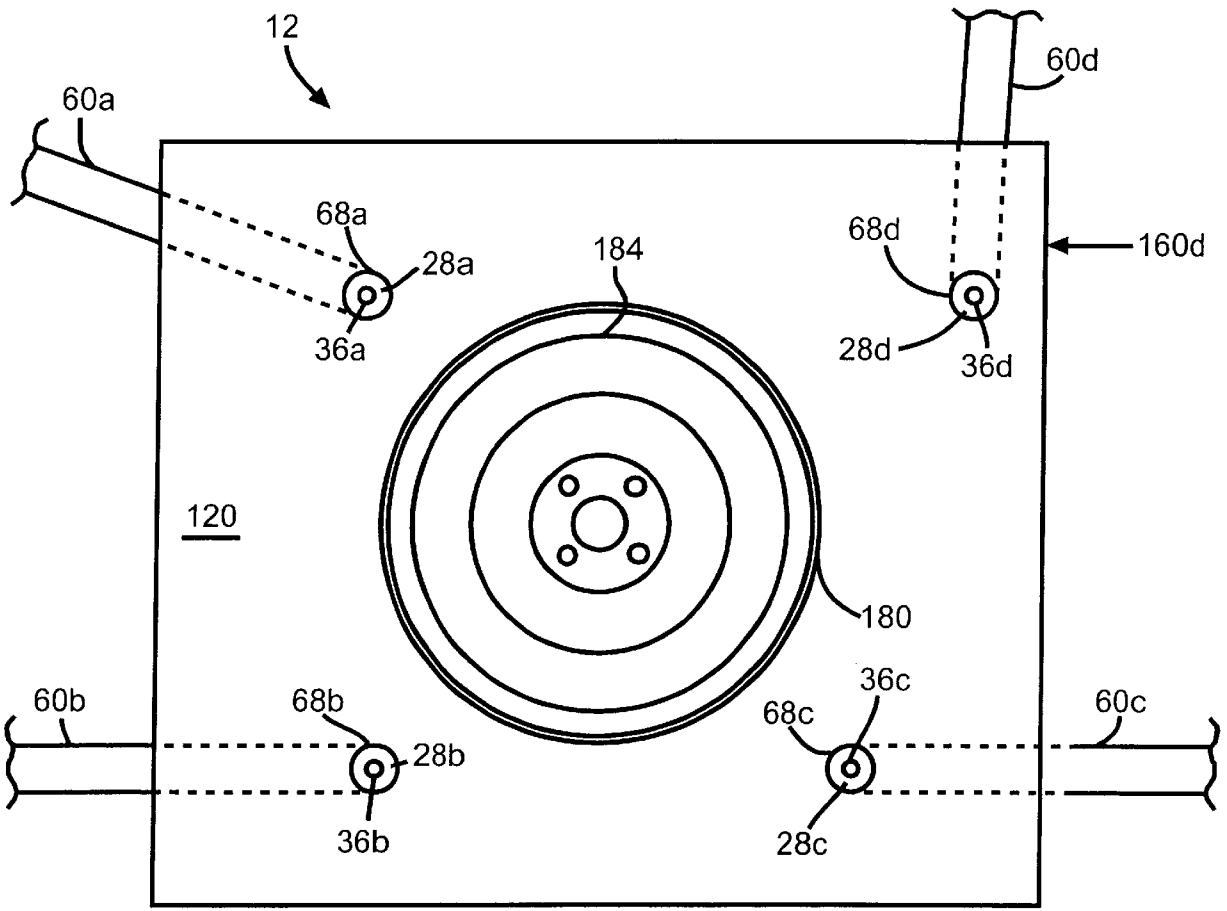
FIG. 3 is a schematic of a wheel mold monitoring apparatus according to the invention.
Figure 4:
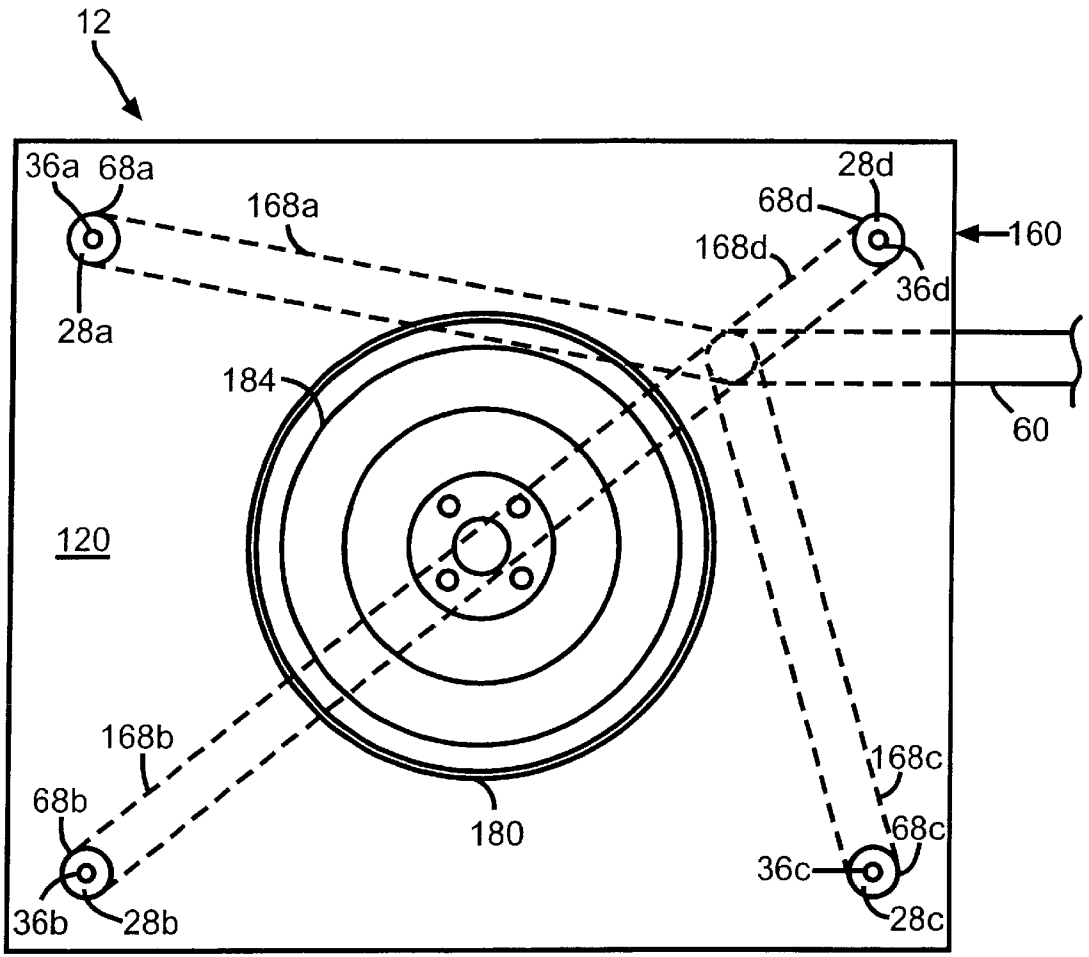
FIG. 4 is a schematic of an alternate embodiment of a wheel mold monitoring apparatus according to the invention.

Knowing the relative positions of the first mold half 160 and the second mold half 164 is useful. The first mold half 160 and the second mold half 164 cooperate to define a mold cavity 180, portions of which are shown in FIGS. 3 and 4, used to create a cast article 184 shown in FIGS. 3 and 4 from a suitable fill material. Nonlimiting examples of cast articles that can be created in the mold cavity 180 include automotive parts, such as for example, wheels (the cast article 184 shown in FIGS. 3 and 4), brake components, suspension components, powertrain components, structural components and the like. A sand core may also be produced in the mold cavity 180. When the first mold half 160 and the second mold half 164 are in their closed, casting positions, the fill material preferably does not leak from the mold cavity 180. The fill material, such as metal or plastic is provided to the mold cavity 180 and is allowed to cool. The first mold half 160 and the second mold half 164 can then be separated from each other to produce the cast article.

A variety of other embodiments of the first restrictor 24 and the second restrictor 28 are contemplated. The first restrictor 24 and the second restrictor 28 need not be identical to each other. In the preferred embodiment, the first restrictor 24 and the second restrictor 28 are removable plates or fixed plates. The first restrictor 24 and the second restrictor 28 may also be removable disks or fixed disks. Likewise, the first restrictor 24 and the second restrictor 28 may be narrowed portions of the fluid line 60.

A wide variety of embodiments of the mold monitoring apparatus 12 are contemplated. Examples of the mold monitoring apparatus 12 that may be used in the molding environment will be presented. It should be understood that the mold monitoring apparatus 12 may be employed in other environments and can be configured other than as illustrated and discussed.

Referring now to FIG. 3, the mold monitoring apparatus 12 of the present invention is illustrated in conjunction with the first mold half 160, though may also be suitably employed with the second mold half 164. The illustrated mold monitoring apparatus 12 includes four fluid supply lines 60*a*–60*d* although any suitable number of fluid lines may be employed and positioned as is desired. The illustrated fluid lines 60*a*–60*d* terminate at a respective outlet 68*a*–68*d*. The illustrated outlets 68*a*–68*d* are generally round holes, although they may have any suitable shape. The illustrated outlets 68*a*–68*d* are positioned in the first mold end surface 120 of the first mold half 160. It should be noted that the outlets 68*a*–68*d* are in fluid communication with the second transducer 20 (shown in FIG. 1) via restrictors 28*a*–28*d* having openings 36*a*–36*d*. It should be noted that the outlets 68*a*–68*d* may each be in fluid communication with a dedicated second transducer, thereby having the mold monitoring apparatus 12 employ four second transducers, one for each of the outlets 68*a*–68*d*.

Referring now to FIG. 4, the mold monitoring apparatus 12 is illustrated in conjunction with the first mold half 160, though it may also be suitably employed with the second mold half 164. The illustrated mold monitoring apparatus 12 includes the fluid supply line 60. The fluid supply line 60 is in fluid communication with four branches 168*a*–168*d* although any suitable number of branches may be employed and positioned as desired. The fluid flows from the fluid line 60 into the branches 168*a*–168*d*. The illustrated branches 168*a*–168*d* each terminate at its respective outlet 68*a*–68*d*. The illustrated outlets 68*a*–68*d* are generally round holes, although they may have any suitable shape. The illustrated outlets 68*a*–68*d* are positioned in the first surface 120 of the first mold half 160. It should be noted that each outlet 68*a*–68*d* includes the second restrictor 28*a*–28*d* having the second opening 36*a*–36*d*.

Figure 5:
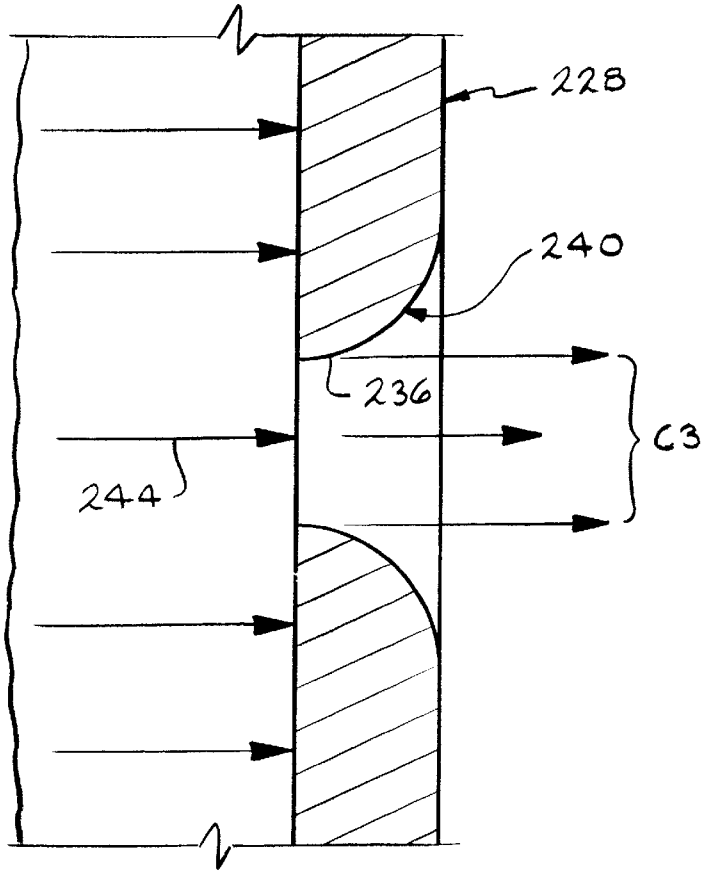
FIG. 5 is a schematic of an alternate embodiment of a restrictor for use with a mold monitoring apparatus according to the invention.

Other embodiments of the restrictor of the invention are contemplated. The restrictor 228 shown in FIG. 5 may be used in lieu of or in conjunction with the first restrictor 24 and/or the second restrictor 28 shown in FIGS. 1 through 4. The restrictor 228 includes an opening 236. The illustrated opening 236 includes a major dimension C3. The illustrated opening 236 also includes a generally rounded downstream portion 240. The arrow 244 indicates a preferred direction of the fluid flow through the restrictor 228.

Figure 6:
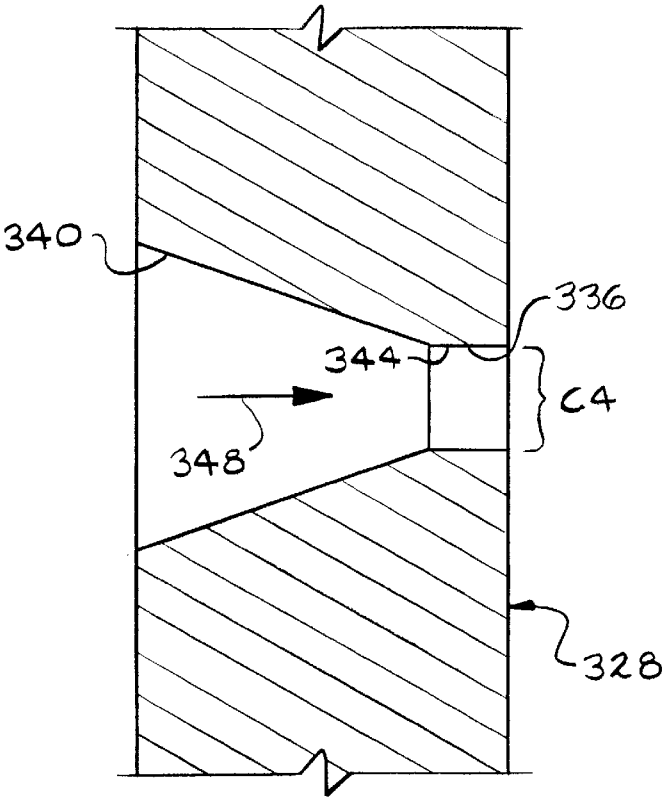
FIG. 6 is a schematic of an alternate embodiment of a restrictor for use with a mold monitoring apparatus according to the invention.

The restrictor 328 shown in FIG. 6 may also be used in lieu of or in conjunction with the first restrictor 24 and/or the second restrictor 28 shown in FIGS. 1 through 4. The restrictor 328 includes an opening 336. The illustrated opening 336 includes a major dimension C4. The illustrated opening 336 also includes a generally conical inlet portion 340 in communication with a generally cylindrical portion 344. The arrow 348 indicates a preferred direction of the fluid flow through the restrictor 328.

Figure 7:
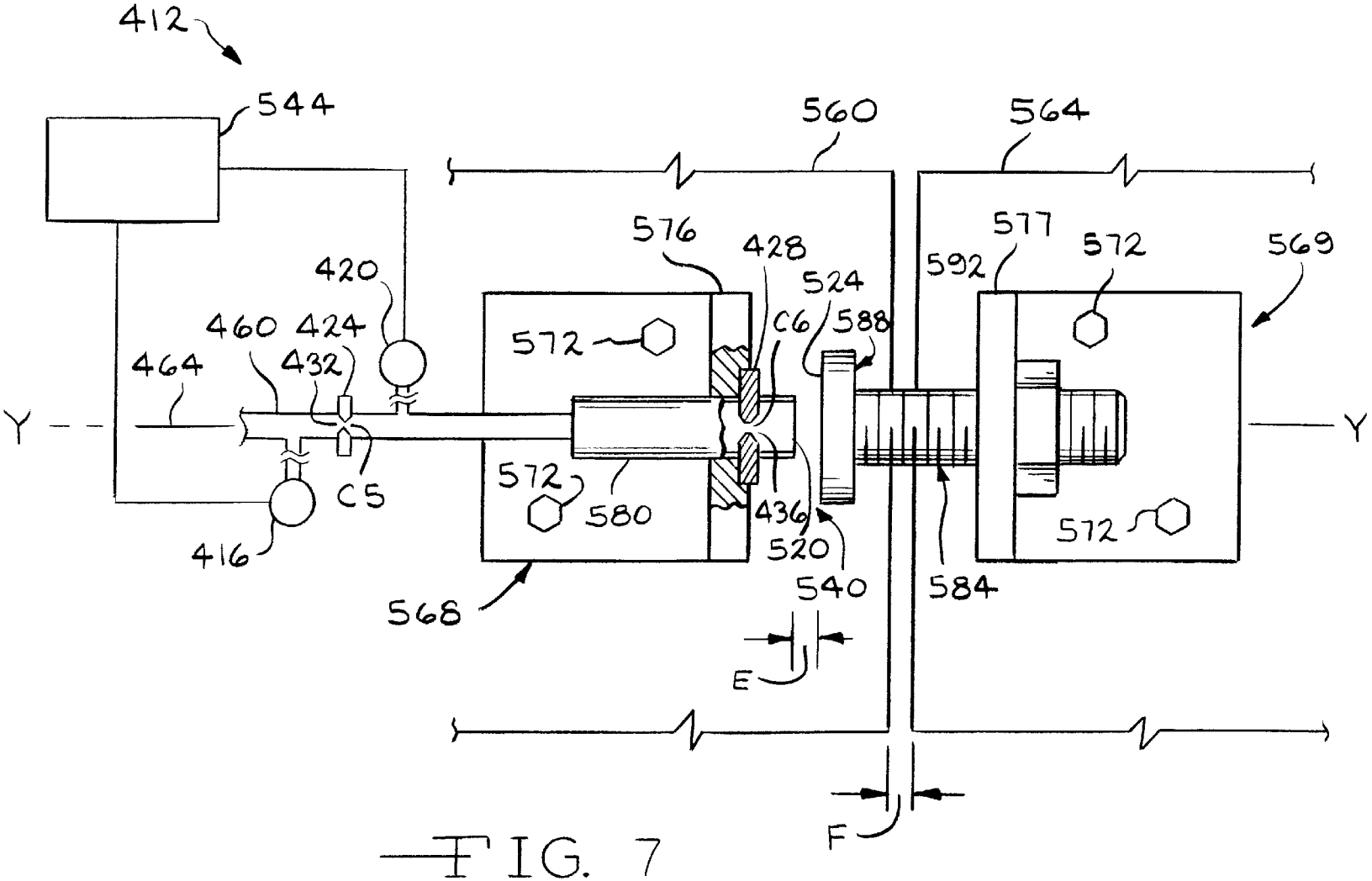
FIG. 7 is a schematic showing an alternate embodiment of the mold monitoring apparatus according to the invention.

Other embodiments of the invention, which position the restrictor differently, are contemplated. FIG. 7 is a schematic showing an alternate embodiment of a mold monitoring apparatus 412 according to the present invention. In the illustrated embodiment, the mold monitoring apparatus 412 includes a first transducer 416, a second transducer 420, a first restrictor 424 and a second restrictor 428. The first transducer 416 and the second transducer 420 are positioned and operative to receive pressure from a fluid and to produce a first signal and a second signal, respectively. The fluid is preferably air, although it may include any suitable gas or liquid. The first signal and the second signal are preferably electrical signals, though they may include any suitable type of signal.

The illustrated first restrictor 424 and the second restrictor 428 are closures having inlet openings 432 and 436, respectively. The inlet openings 432 and 436 are preferably stepped openings. The illustrated inlet opening 432 is a round hole positioned approximately in the center of the first restrictor 424. The illustrated inlet opening 436 is a round hole positioned approximately in the center of the second restrictor 428. The inlet opening 432 defines a first restrictor major dimension C5. The major dimension C5 is understood to be the largest chord that can be drawn at the smallest part of the cross-section of the inlet opening 432. When the inlet opening 432 is a circle, the major dimension C5 is the diameter thereof. The inlet opening 436 defines a second restrictor major dimension C6. The major dimension C5 is understood to be the largest chord that can be drawn at the smallest part of the cross-section of the inlet opening 436. When the second opening 436 is a circle, the major dimension C6 is a diameter of the inlet opening 436. Preferably, the area of the inlet opening 432 is approximately equal to the area of the inlet opening 436. Also, the first restrictor 424 and the second restrictor 428 are preferably removable plates.

The illustrated mold monitoring apparatus 412 includes a fluid supply line 460. The illustrated fluid supply line 460 is a suitable conduit or pipe and is positioned to allow the fluid to flow in the fluid supply line 460 in the general direction indicated by the arrow 464. The fluid supply line 460 is preferably positioned to allow for fluid communication between the first transducer 416, the first restrictor 424 and the second transducer 420, and the second restrictor 428. The mold monitoring apparatus 412 may also include an optional air supply unit, filter, dryer, regulator and header similar to the mold monitoring apparatus 12 shown in FIG. 1. Likewise, the mold monitoring apparatus 412 may also be employed in a hostile environment in a manner and position similar to that of FIG. 1.

In the illustrated embodiment, the mold monitoring apparatus 412 includes a first line end surface 520 of a first mold half 560 and an impact surface 524 of a second mold half 564. In the illustrated embodiment, the first line end surface 520 is preferably a generally flat surface and is positioned generally parallel to the impact surface 524, which is preferably a generally flat surface. The illustrated inlet opening 436 terminates at the first line end surface 520. In operation, the first line end surface 520 and the impact surface 524 are selectively movable relative to each other, though one of the first line end surface 520 the impact surface 524 can be stationary. The first line end surface 520 and the impact surface 524 move relative to each other in a manufacturing process or other operation. The inlet opening 436 terminates upstream from the first line end surface 520.

For the portion of the mold monitoring apparatus 412 shown in FIG. 7, the first line end surface 520 and the impact surface 524 are spaced apart from each other by a fluid or gap 540. It will be appreciated that the first line end surface 520 and the impact surface 524 are spaced apart by a distance "E" along mold axis "Y." The illustrated axis "Y" is oriented approximately perpendicular to the first line end surface 520 and the impact surface 524. It will also be appreciated that the first mold half 560 and the second mold half 564 are separated by a distance "F."

In a preferred embodiment, the fluid supply line 460 is operatively connected to the first mold half 560 by a bracket 568. Likewise, the impact surface 524 is operatively connected to the second mold half 564 by a bracket 569. The brackets 568 and 569 may be integrally formed with the first mold half 560 and second mold half 564, respectively. Likewise, the brackets 568 and 569 may be connected to the first mold half 560 and second mold half 564 by one or more fasteners 572. Non-limiting examples of suitable fasteners include bolts, screws, clamps, pins, welds, adhesive and the like. The brackets 568 and 569 preferably include outwardly extending flanges 576 and 577, respectively.

In a preferred embodiment, the flanges 576 and 577 support and position a nozzle 580 and a set arm 584, respectively. The nozzle 580 is optional and is operatively connected to the fluid supply line 460. The nozzle 580 is operative to support the second restrictor 428. The nozzle 580 is preferably an elongated cylinder, although the nozzle 580 may have any suitable shape. The nozzle 580 is preferably rigidly connected to the flange 576 of the bracket 568. In a preferred embodiment, the nozzle 580 is removable for servicing or for removal of the second restrictor 428.

The set arm 584 is preferably an adjustable bolt. In a preferred embodiment, the set arm 584 includes a head 588 and a shaft 592. The shaft 592 is selectively moveable within the flange 577 of the bracket 569 to calibrate the distance "E" as desired. A nut 596 may be provided to limit the movement of the set arm 584.

Figure 8:
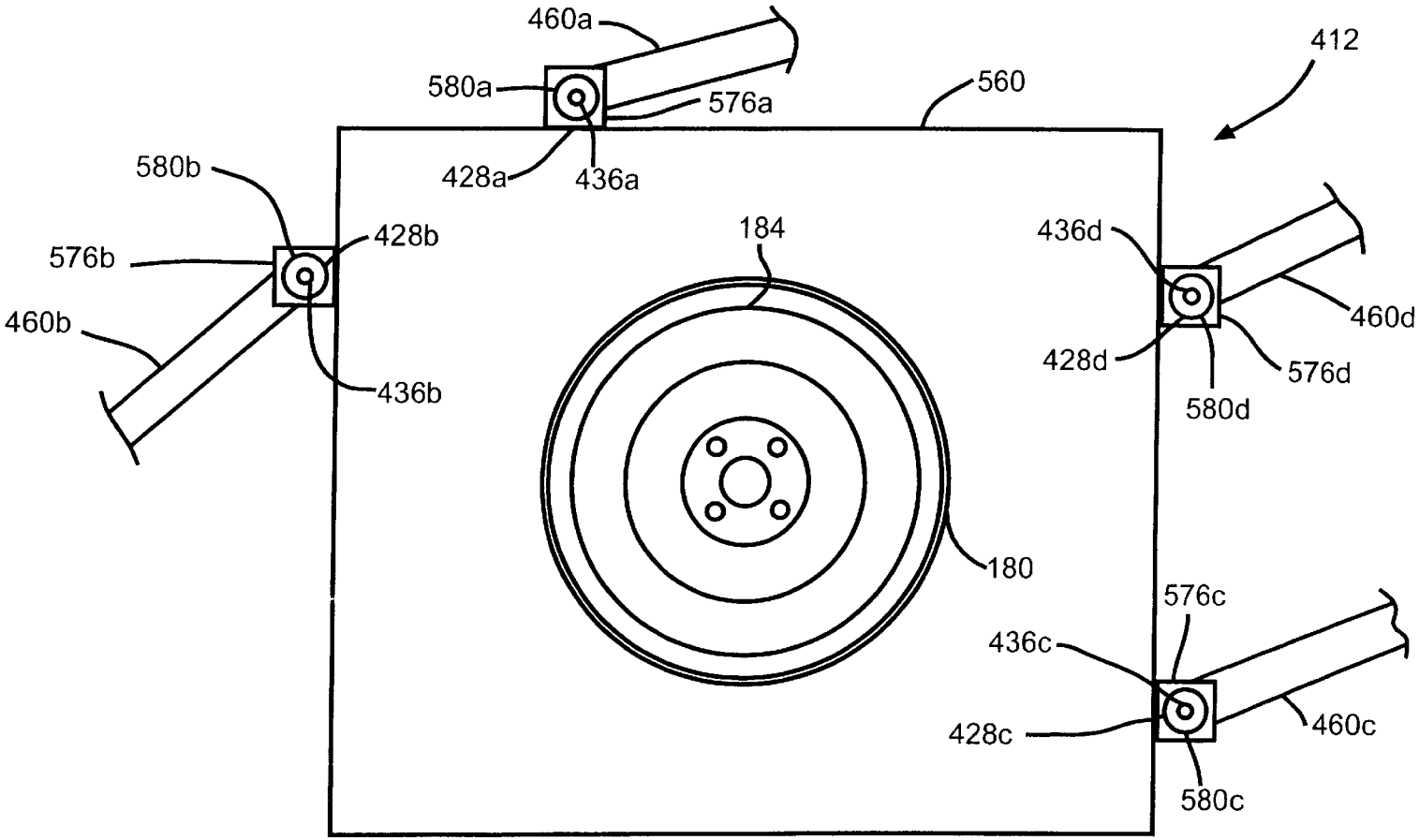
FIG. 8 is a schematic of an alternate embodiment of a wheel mold monitoring apparatus according to the invention.

Operation of the mold monitoring apparatus 412 shown in FIGS. 7 and 8 is similar to the operation of the operation of the mold monitoring apparatus 12 shown in FIGS. 1 and 2. The first transducer 416 is exposed to the fluid flowing through the fluid supply line 460. When the first transducer 416 receives the fluid, the first transducer 416 generates a first signal. The first signal preferably corresponds to the pressure of the fluid supplied to the first transducer 416. The fluid flows through the inlet opening 432 of the first restrictor 424 to the second transducer 420. When the second transducer 420 receives the fluid, the second transducer 420 generates a second signal. The second signal preferably corresponds to the pressure of the fluid supplied to the second transducer 420. The fluid then flows through the inlet opening 436 of the second restrictor 428.

The fluid next flows into the fluid gap 540 when the first line end surface 520 and the impact surface 524 are spaced apart by the distance D. When the first line end surface 520 and the impact surface 524 are moved toward one another, the fluid flowing into the fluid gap 540 impinges on the impact surface 524. The fluid flow into the fluid gap 540 completely stops when the first line end surface 520 and the impact surface 524 are positioned substantially in contact, thus obstructing flow through the second opening 436.

The relative movements of the first line end surface 520 and the impact surface 524 produces a change in the second signal generated by the second transducer 420. It will be appreciated that the impact surface 524 is an impact surface for the fluid flow into the fluid gap 540. In operation, the first line end surface 520 and the impact surface 524 move toward one another thus decreasing the distance "E". It will be appreciated that, as the distance "E" decreases the second signal increases. Likewise, as the distance "E" increases, the second signal decreases. Therefore, the distance "E" and thus the relative positions of the first line end surface 520 and the impact surface 524 can be determined by comparing the first signal generated by the first transducer 416 and the second signal generated by the second transducer 420.

The illustrated mold monitoring apparatus 412 includes a controller 544, though a controller 544 is not necessary to practice the invention. The controller 544 is preferably operatively connected to the first transducer 416 and the second transducer 420 so as to receive the respective signals generated by each transducer. In the preferred embodiment, the controller 544 is operative to compare the first signal and the second signal to thereby determine the relative positions of the first line end surface 520 and the impact surface 524. The controller 544 may also be employed to generate a signal representative of the distance "E." The mold monitoring apparatus 412 of the present invention may be employed in a wide variety of environments. The mold monitoring apparatus 412 may be employed in a hostile environment similar to the hostile environment 100 (shown in FIG. 1) that is a molding environment, although use of the mold monitoring apparatus 412 is not limited to the molding environment.

Referring now to FIG. 8, the mold monitoring apparatus 412 of the present invention is illustrated in conjunction with the first mold half 560. The first mold half 560 includes the mold cavity 180 (shown also in FIGS. 3 and 4) which contains the cast article 184. The illustrated mold monitoring apparatus 412 includes four fluid supply lines 460*a*–460*d* although any suitable number of fluid lines may be employed and positioned as is desired. The illustrated fluid lines 460*a*–460*d* terminate at the respective nozzles 580*a*–580*d*. The flanges 576*a*–576*d* support the nozzles 580*a*–580*d* and the second restrictors 428*a*–428*d*. The nozzles 580*a*–580*d* support the second restrictors 428*a*–428*d* having openings 436*a*–436*d*. It should be noted that the openings 436*a*–436*d* are in fluid communication with the second transducer 420 (shown in FIG. 7). It should be noted that the openings 436*a*–436*d* may each be in fluid communication with a dedicated second transducer, thereby having the mold monitoring apparatus 412 employ four of the second transducers, one for each of the openings 436*a*–436*d*.

The first mold half 560 and the second mold half 564 cooperate to define a mold cavity 180, portions of which are shown in FIGS. 3 and 4, used to create a cast article 184 shown in FIGS. 3 and 4 from a suitable fill material. Nonlimiting examples of cast articles that can be created in the mold cavity 180 include automotive parts, such as for example, wheels (shown in FIGS. 7 and 8), brake components, suspension components, powertrain components, structural components and the like. A sand core may also be produced in the mold cavity 180. When the first mold half 560 and the second mold half 564 are in their closed, casting positions, the fill material preferably does not leak from the mold cavity 180. The fill material, such as metal or plastic is provided to the mold cavity 180 and is allowed to cool. The first mold half 560 and the second mold half 564 can then be separated from each other to produce the cast article.

The principle and mode of operation of this invention have been described in its preferred embodiments. However, it should be noted that this invention may be practiced otherwise than as specifically illustrated and described without departing from its scope.

What is claimed is:

1. A method to detect a distance between two mold halves of a mold comprising the steps of:

providing a fluid line having an inlet and an outlet, the fluid line being positioned to allow for a flow of a fluid from the inlet to the outlet;

providing a first mold half having a bracket secured thereto for supporting a first member, the first member defining a fixed first end surface;

providing a second mold half having a bracket secured thereto for supporting a second member having an adjustable set arm, the second member defining a second end surface which via the adjustable set arm can be moved relative to the first end surface to define a predetermined gap between the fixed first end surface and the second end surface which is used to determine the distance between the first mold half and the second mold half;

positioning a first restrictor and a second restrictor in the fluid line, the first restrictor and the second restrictor being in fluid communication with each other; and positioning a first transducer and a second transducer in the fluid line, the first transducer and the second transducer being in fluid communication with each other; and the first transducer producing a first signal when the first transducer receives the fluid from the inlet, and the second transducer producing a second signal when the second transducer receives the fluid from the first restrictor, wherein the first signal and the second signal are compared to determine the relative positions of the first mold half and the second mold half.

2. The method of claim 1 wherein the outlet is provided in the first member.

3. The method of claim 1 wherein the second restrictor is supported by the first member.

4. The method of claim 1 wherein the first transducer is an air pressure transducer.

5. The method of claim 1 wherein the first and second end surfaces are positioned within a hostile environment that may prevent closing of the first and second mold halves.

6. The method of claim 5 wherein the hostile environment includes a temperature outside the range of from about 40 degrees Fahrenheit to about 100 degrees Fahrenheit, a pressure no less than about one atmosphere, or a noise no less than about 90 decibels.

* * * * *